United States Patent [19]

Rees

[11] 4,324,975

[45] Apr. 13, 1982

[54] TAX CALCULATOR

[76] Inventor: Robert L. Rees, 233 N. Michigan Ave., Chicago, Ill. 60601

[21] Appl. No.: 122,279

[22] Filed: Feb. 19, 1980

[51] Int. Cl.[3] ..... G06G 1/02; G06C 3/00

[52] U.S. Cl. ..... 235/70 A; 235/85 R

[58] Field of Search ..... 235/69, 70 R, 85 R, 235/70 A, 89 R; 116/323; 35/75

[56] References Cited

U.S. PATENT DOCUMENTS

| | | | |
|---|---|---|---|
| 1,895,903 | 1/1933 | Thompson | 235/89 R |
| 3,091,389 | 5/1963 | Wiken | 235/70 R |
| 3,747,847 | 7/1973 | Cohen | 235/70 R |

OTHER PUBLICATIONS

E. F. Lavrin, "Income Tax Finder", Arlington Tax Finders, 1964.

Harris Trust and Savings Bank, "Federal Estate Tax Calculator", 1977.

*Primary Examiner*—L. T. Hix
*Assistant Examiner*—Benjamin R. Fuller
*Attorney, Agent, or Firm*—John S. Fosse

[57] ABSTRACT

A hand-held calculating device for calculating Federal Income Taxes or the like includes substantially flat, elongate front and rear cover members and an insert card. Suitable structure is provided for joining the cover members with the card slidably insertable therebetween. The card bears a plurality of columns on both front and rear sides thereof, each column bearing a plurality of lines of tax figures or the like. A number of through apertures or windows are provided on both front and rear cover members for viewing selected lines and columns of figures on the insert card.

10 Claims, 5 Drawing Figures

TAX CALCULATOR

BACKGROUND OF THE INVENTION

This invention relates generally to the field of calculators and more particularly to a telescoping hand-held calculator for a special purpose use, such as in the calculating of income taxes and the like.

The accounting profession as well as many scientific disciplines frequently require numerical data or figures based upon calculations from tables of functions or the like. For example, in computing or calculating taxes such as income taxes and the like, it is often necessary to refer to numerous tables and perform a number of independent calculations based upon one or more of these tables to arrive at desired subtotal or total tax figures.

In the income tax field there are as many as eight separate tables of taxes or rates of tax for taxpayers having various statuses. One such table must be used to calculate the taxes on a joint return while a different table is required for those on a single return, head of household return or separate married returns. Similarly, yet further tables must be consulted for the taxes on income of estates and trusts, on corporate income, and for Federal Estate and Gift tax calculations.

While such tables are generally available published in book form, it is nonetheless somewhat inconvenient to refer to such tables. Moreover, a possibility of error is always present as the eye may stray from the desired line in reading one figure from among numerous figures on a printed page.

Various hand-held slide rule-type calculator devices have been proposed in the past for aiding accountants or others in performing such calculations. These devices generally include columns of figures arranged on an insert card to be read through various through-apertures or windows in a cover or receptacle, through which the card bearing the columns of figures is slidably movable. Since these tables are subject to change from time to time, it requires considerable ingenuity to properly arrange all of the necessary columns of figures on a single slidable insert card of reasonable size. More difficult yet is the arrangement of the windows in the cover members in such a calculator to be in registry with the proper figures from suitable lines and columns to obtain the necessary tabular reading in each tax category and at each taxable income figure.

OBJECTS AND SUMMARY OF THE INVENTION

Accordingly, it is a general object of the present invention to provide a new and improved hand-held slide rule-type calculator device for calculating Federal income taxes and the like.

A more specific object is to provide a calculator in accordance with the general object which reproduces complete Federal tax tables for corporate, personal and trust income, as well as for estate and gift taxes, and includes suitable windows for isolating and reading single tax figures and rates from each table while avoiding the confusion resulting from multiple such figures being displayed at any one time.

Yet another object is to provide a calculator in accordance with the foregoing objects which further provides percentage rates of taxes and displays suitable taxable income or taxable transfer indicia in each display window for defining the amounts at which the next higher and next lower figure and/or rate on the table appears.

Briefly, a hand-held apparatus for calculating from columnar data, in accordance with the present invention, comprises: substantially planar, elongate front and rear cover members assembled to define a slot and apertured to expose selected items of data. An insert card of substantially similar length to the front and rear cover members is slidably mounted in the slot. The insert card bears a plurality of columns each comprising a plurality of lines of data. A transparent pocket is provided on one of the cover members and is arranged to receive a business card.

Other objects, features and advantages of the present invention will become more readily apparent upon reading the following detailed description of the illustrated embodiment, together with reference to the accompanying drawings wherein:

DETAILED DESCRIPTION OF THE ILLUSTRATED EMBODIMENT

Figure 5:
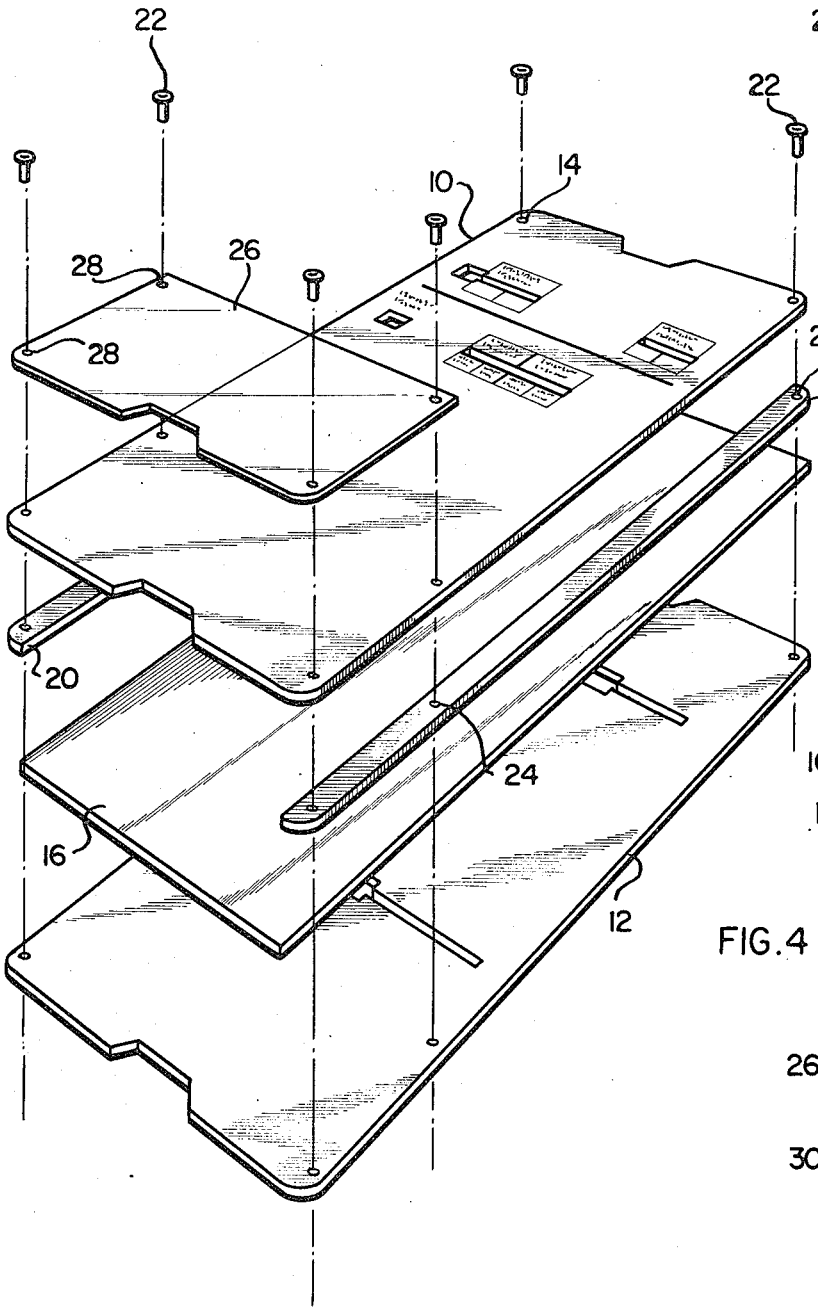
FIG. 5 is an exploded perspective view of the calculator apparatus of FIGS. 1 through 4.

Referring initially to FIG. 5, the structural details of the hand-held calculator device of the present invention are shown in an exploded perspective view. Briefly, the invention includes a similarly dimensioned front cover member 10 and rear cover member 12. The covers 10 and 12 are provided with a plurality of fastener-receiving apertures 14 about their peripheries, whose function will be discussed shortly. A slidable insert card 16 is of similar length dimension to the front and rear covers 10 and 12 but of slightly smaller width.

Advantageously, a pair of spacer strips 18, 20 are of similar length to front and rear covers 10, 12 but of relatively narrow width, such that the total width dimension formed by insert card 16 and spacer members 18, 20 is similar to the total width of either the front cover member 10 or rear cover member 12. Accordingly, a plurality of fasteners 22, which may be rivets, for example, are provided for attaching the front cover 10 to the rear cover 12, with the spacer strips 18, 20 being interposed therebetween at the respective lateral side edges thereof. To this end the spacer strips 18, 20 are also provided with suitable apertures 24 which are in alignment with the apertures 14 for receiving the rivets 22 or other fastner members therethrough.

In accordance with a preferred feature of the invention, a transparent member 26 is also provided, which may be of any suitable transparent plastics or like material. This transparent member 26 is of substantially similar width dimension to front cover member 10 but of substantially lesser longitudinal extent, and is superimposed over a minor fractional portion of the longitudinal extent of the front cover 10. Suitable apertures 28 are provided in the transparent member 26 to provide for its attachment by means of selected ones of the rivets or fasteners 22, to the front cover 10, at the time of assembly of the calculator apparatus. Advantageously, this transparent member 26 is of suitable dimension for accommodating a standard size business card 30 (see FIG. 2) or the like therein, thereby to identify an accountant, for example, who may wish to distribute such calculators to clients.

Figure 1:
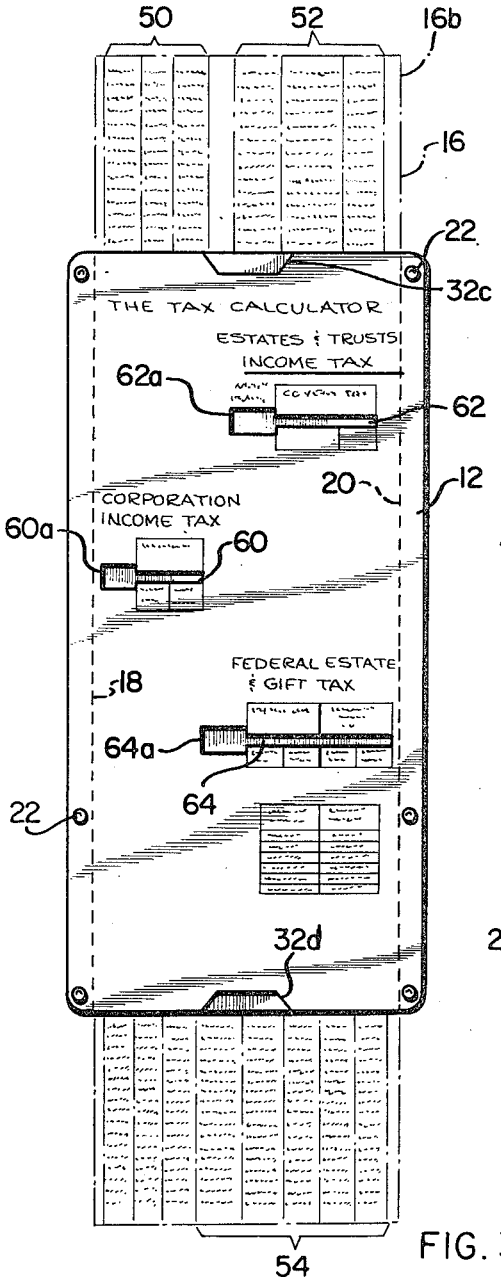
FIG. 1 is an elevational view of one side of the tax calculator of the present invention.
Figure 2:
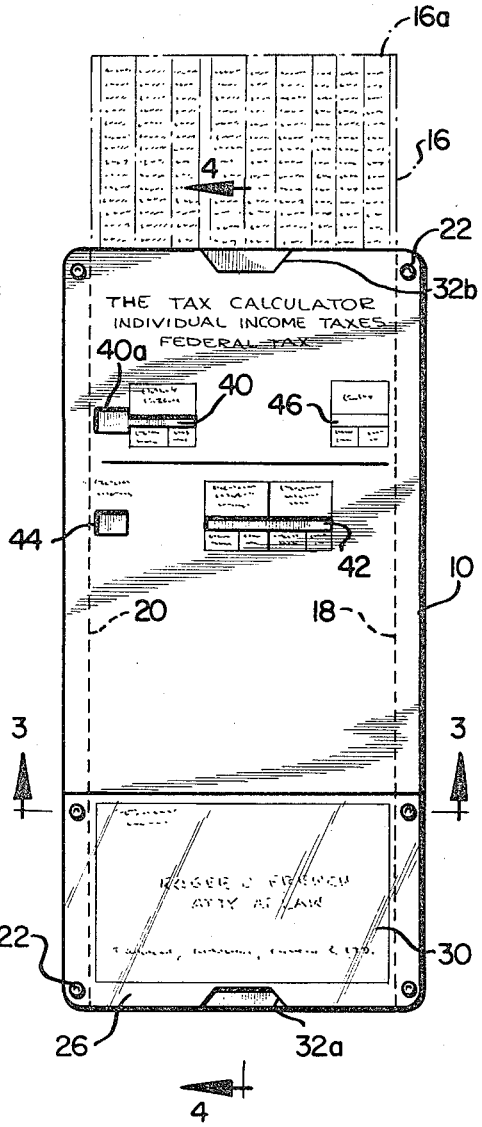
FIG. 2 is an elevational view of the opposite side of the tax calculator of the present invention.
Figure 3:
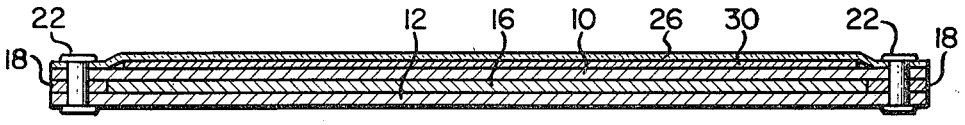
FIG. 3 is a side elevation view taken generally along the line 3—3 of FIG. 2.
Figure 4:
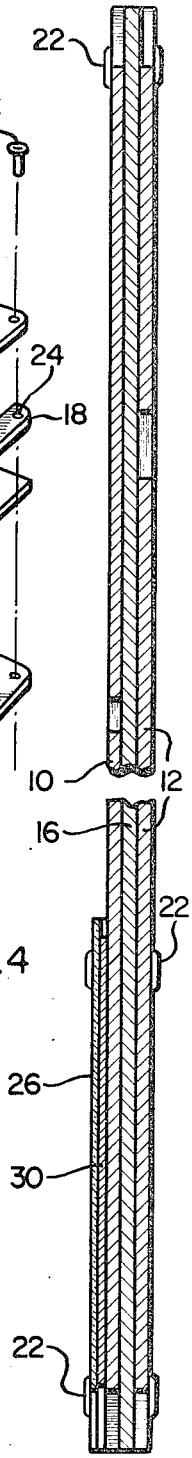
FIG. 4 is a side elevation view taken generally along the line 4—4 of FIG. 2.

Reference is also invited to FIGS. 3 and 4 which show lateral and side views, respectively, of the assembled device of FIG. 5, whose front and rear views are seen in FIGS. 1 and 2.

Reference is next invited to FIGS. 1 and 2, where further features of the invention are best viewed. Advantageously, the front and rear covers 10, 12 each includes top and bottom, centrally located cut-outs or slots, 32*a*, 32*b*, 32*c* and 32*d* to allow convenient gripping of an edge portion of the insert card 16. This facilitates slidable movement of the card 16 with respect to the other parts of the assembled calculator device, and in particular with respect to a number of through apertures or windows provided on the front and rear covers 10, 12, which windows will be described hereinbelow.

Reference is invited to FIG. 2, wherein one side of the calculator which shall hereinafter be designated as the "front" side thereof, is illustrated. Initially, and as mentioned above, the transparent member 28 which also advantageously forms a pocket for receiving a business card 30 or the like is positioned at the bottom portion of this front cover member, as viewed in FIG. 2. The front cover 10 also includes four through apertures or viewing windows hereinafter designated as follows: a first window 40, a second window 42, a third window 44 and a fourth window 46. These windows, 40, 42, 44 and 46 are arranged for selectively exposing lines of tax figures or the like which are arranged in columns on the corresponding front side of the insert card 16.

Referring briefly to the insert card 16, it will be noted that tax tables or figures are arranged thereon in predetermined columns and lines on both the front side 16*a* thereof as viewed in FIG. 2 and on the rear side 16*b* thereof as viewed in FIG. 1. On the front side 16*a* of the insert card 16 these columns are nine in number and are substantially equally spaced across the width or horizontal dimension of the insert card 16 throughout its length. On the rear side 16*b* of insert card 16, as viewed in FIG. 1, however, the columnar arrangement is somewhat different.

The first three columns of figures on the rear side 16*b*, reading from left to right, and designated generally by the reference numeral 50, extend the entire length of insert card 16. However, the remaining width portion of rear side 16*b* contains three columns, designated generally by the reference numeral 52, extending over substantially the top third of rear side 16*b* as viewed in FIG. 1. The bottom substantially two-thirds of rear side 16*b* contains five columns, designated by generally reference numeral 54, horizontally offset from the columns 52.

Referring once again to the windows 40, 42, 44 and 46 on the front cover member 10, it will be seen that the windows 40, 42 and 46 are arranged horizontally across the front side so as to expose figures in all of the nine columns on front side 16*a* of the insert card 16. However, the window 42 is vertically offset from the windows 40 and 46 which are at the same vertical level with respect to the cover member 10. The remaining window 44 is horizontally offset from window 42 but at substantially the same vertical level.

More specifically, the first window 40 is arranged for simultaneously exposing figures in aligned lines of the first, second and third columns of front side 16*a* of the insert card 16 while the fourth window 46 is arranged or positioned for simultaneously exposing figures in horizontal alignment with the figures exposed by the first window 40, but in the eighth and ninth columns. In similar fashion, the second window 42 and third window 44 are arranged, respectively, for exposing horizontally aligned figures in the fourth, fifth, sixth and seventh columns and figures in the first column of front side 16*a* of the insert card 16.

Referring now to FIG. 1, the first window 60 in the rear cover member 12 is positioned for simultaneously exposing horizontally aligned lines in the first, second and third columns 50 of the rear side 16*b* of the insert card 16. The window 62, vertically offset from the window 60, is positioned for simultaneously exposing horizontally aligned figures in the three columns 52 of the rear side 16*b* of the insert card 16. Similarly, the window 64 is vertically offset from the windows 60 and 62 and is positioned for simultaneously exposing horizontally aligned lines in each of the five columns 54 of the rear side 16*b* of the insert card 16.

In accordance with a further feature of the invention the windows 40 and 44 on front cover 10, as well as the windows 60, 62 and 64 of the rear cover 12 each have a portion of relatively greater vertical extent for simultaneously exposing additional lines of the respective columns which they overlie on the front and rear sides 16*a*, 16*b* of the insert card 16. In this regard, an enlarged portion 40*a* of the window 40 is of sufficient vertical extent to expose two additional lines of the first column on front side 16*a*. In particular, the lines exposed are those immediately above and immediately below the line in alignment with the lines exposed by the remaining portion of the window 40. In similar fashion, the windows 60, 62 and 64 of the rear cover member 12 each has a similar enlarged portion 60*a*, 62*a*, and 64*a*, each exposing two additional lines in its respective column, one above and one below the line in alignment with those lines exposed by the remaining portions of each of the windows 60, 62 and 64.

In similar fashion, the window 44 is of sufficient vertical extent to expose two additional lines in the first column of the front side 16*a* of insert card 16. These lines are the ones located immediately above and immediately below the line in alignment with the lines exposed by the window 42.

For purposes of illustrating a specific and preferred embodiment of the invention, the respective windows are generally designated as follows:

the first portion 40*a* of window 40 and the window 44 expose figures corresponding to taxable income for purposes of the Federal Income Tax. The remaining portion of the window 40 exposes figures corresponding to total tax dollars and percent on excess for a joint return. Similarly, the window 46 exposes figures corresponding to total tax dollars and percent on excess for a single return. In similar fashion, the window 42 exposes four figures respectively corresponding to total tax dollars and percent on excess for a head of household return and to total tax dollars and percent on excess for a separate, marrried return.

The window portion 60*a* on the rear cover 12 exposes a taxable income figure while the remaining portion of window 60 exposes the figures corresponding to total tax dollars and percent on the excess for a corporate income tax. In similar fashion, the window portion 62*a* exposes a taxable income figure while the remaining portion of window 62 exposes a total tax figure and percent on excess figure for an estate or trust income tax return. The window 64 is designated as the Federal Estate and Gift Tax window and the portion 64*a* thereof exposes a figure designated as taxable transfer. The remaining portion of window 64 exposes figures corresponding respectively to total tax dollars and percent on excess of the Federal tax and to maximum State death tax credits in total dollars and percent on excess, respectively.

While the invention has been illustrated and described above with reference to specific or preferred embodiments, the invention is not limited thereto. On the contrary, various modifications, alternatives and changes may occur to those skilled in the art and are therefore to be considered as forming a part of the present invention insofar as they fall within the spirit and scope of the appended claims.

The invention is claimed as follows:

1. A tax calculator apparatus comprising: a substantially flat front cover member of predetermined width and of predetermined length substantially greater than said predetermined width, a substantially flat rear cover member of substantially the same length and width of said front cover member, a pair of relatively narrow, elongate spacer members interposed between said front and rear cover members and at opposing lateral sides thereof so as to form a relatively thin pocket having enclosed lateral side portions and open top and bottom portions, a plurality of fasteners for engaging said front and rear cover members with said spacer members to define said pocket, an insert card of substantial similar length to said front and rear cover members and substantially filling said pocket and slidably mounted therein, a plurality of vertical columns each comprising a plurality of horizontal lines on both front and rear sides of said insert card, a first window in said front cover member for simultaneously exposing horizontally aligned lines in first, second and third adjacent ones of said columns, a second window and a third window in said front cover member positioned respectively for simultaneously exposing horizontally aligned lines in said first column and in fourth, fifth, sixth and seventh ones of said plurality of columns, and a fourth window in said front cover member positioned for simultaneously exposing horizontally aligned lines in eighth and ninth ones of said plurality of columns, a fifth window in said rear cover member for simultaneously exposing horizontally aligned lines in first, second and third ones of said plurality of columns formed on the rear side of said insert card, a sixth window formed in said rear cover member for simultaneously exposing horizontally aligned lines in fourth, fifth, sixth, seventh and eighth ones of said plurality of columns on said rear side of said insert card and a seventh window formed in said rear cover member for simultaneously exposing a horizontally aligned lines in ninth, tenth and elventh ones of said columns on the rear side of said insert card, said first and fourth windows being positioned for exposing horizontally aligned columns of the front side of the insert card, and said second window being vertically offset from said first and fourth windows.

2. Apparatus according to claim 1 wherein said third window is vertically offset from the first and fourth windows and at the same vertical level as said second window.

3. Apparatus according to claim 1 wherein said fifth, sixth and seventh windows are vertically offset with respect to each other, each for exposing different groups of lines in the columns of said rear side of said insert card.

4. Apparatus according to claim 1 wherein said fifth, sixth and seventh windows are vertically offset from each other so as to expose different groups of lines in said columns of the rear side of said insert card.

5. Apparatus according to claim 1 wherein said first window includes a first portion of sufficient vertical extent to simultaneously expose at least one line of said first column both above and below the lines of said second and third columns exposed by the remaining portion of first said window.

6. Apparatus according to claim 1 wherein said fifth, sixth and seventh windows each includes a portion of sufficient vertical extent to expose at least one additional line both above and below the lines exposed by the remaining portions of said fifth, sixth and seventh windows, respectively.

7. Apparatus according to claim 5 wherein said third window is of sufficient vertical extent to expose three vertically adjacent lines in said first column.

8. Apparatus according to claim 4 wherein said first window includes a first portion of sufficient vertical extent to simultaneously expose at least one line of said first column both above and below the lines of said second and third columns exposed by the remaining portion of said first window.

9. Apparatus according to claim 4 wherein said fifth, sixth and seventh windows each includes a portion of sufficient vertical extent to expose at least one additional line both above and below the lines exposed by the remaining portions of said fifth, sixth and seventh windows, respectively.

10. Apparatus according to claim 8 wherein said third window is of sufficient vertical extent to expose at least three vertically adjacent lines in said first column.

* * * * *